US006854509B2

(12) United States Patent
Mitchell

(10) Patent No.: US 6,854,509 B2
(45) Date of Patent: Feb. 15, 2005

(54) FOIL STRUCTURES FOR REGENERATORS

(76) Inventor: Matthew P. Mitchell, 151 Alvarado Rd., Berkeley, CA (US) 94705

( * ) Notice: Subject to any disclaimer, the term of this patent is extended or adjusted under 35 U.S.C. 154(b) by 540 days.

(21) Appl. No.: 09/903,302

(22) Filed: Jul. 10, 2001

(65) Prior Publication Data

US 2003/0010473 A1 Jan. 16, 2003

(51) Int. Cl.[7] ..... F28D 19/00

(52) U.S. Cl. ..... 165/10; 165/4; 165/77; 165/78; 165/79; 165/146; 165/170; 62/6

(58) Field of Search ..... 165/4, 10, 77, 165/78, 79, 146, 170; 62/6

(56) References Cited

U.S. PATENT DOCUMENTS

| | | | | |
|---|---|---|---|---|
| 1,808,921 A | | 6/1931 | Fraenkl | |
| 2,701,130 A | * | 2/1955 | Boestad | 165/10 |
| 3,367,406 A | * | 2/1968 | Gerben et al. | 165/10 |
| 3,373,798 A | | 3/1968 | Brummett | |
| 3,910,344 A | | 10/1975 | Hagen | |
| 3,958,626 A | * | 5/1976 | Klein | 165/8 |
| 4,200,441 A | * | 4/1980 | Honmann et al. | 96/125 |
| 4,386,505 A | * | 6/1983 | Little | 62/51.1 |
| 4,449,573 A | * | 5/1984 | Pettersson et al. | 165/10 |
| 4,615,378 A | * | 10/1986 | Mizuno et al. | 165/10 |
| 4,651,808 A | * | 3/1987 | Mizuno | 165/4 |
| 4,901,787 A | * | 2/1990 | Zornes | 165/4 |
| 4,934,453 A | * | 6/1990 | Ganz et al. | 165/165 |
| 5,429,177 A | * | 7/1995 | Yaron et al. | 165/10 |
| 5,797,449 A | * | 8/1998 | Oswald et al. | 165/165 |
| 6,003,320 A | | 12/1999 | Okamura et al. | |
| 6,065,295 A | | 5/2000 | Hafner | |
| 6,071,593 A | * | 6/2000 | Lang et al. | 428/167 |
| 6,115,919 A | * | 9/2000 | Oswald et al. | 29/890.039 |
| 6,131,644 A | * | 10/2000 | Kohara et al. | 165/10 |
| 6,347,453 B1 | * | 2/2002 | Mitchell | 29/890.034 |
| 6,585,034 B2 | * | 7/2003 | Oswald | 165/10 |
| 6,732,785 B2 | * | 5/2004 | Mitchell | 165/79 |
| 6,745,822 B1 | * | 6/2004 | Mitchell | 165/10 |
| 2001/0039801 A1 | * | 11/2001 | Bliesner et al. | 60/517 |

OTHER PUBLICATIONS

J. M. Lee, et al., "A Regenerator That Will Perform at Moderately High Frequency Below 10 Kelvin for Use in a Pulse Tube Cooler" Advances in Cryogenic Engineering, 2000, pp. 349–356, esp. p. 349, vol. 45A, Kluwer Academic/Plenum Publishers, New York, USA.

Hofmann et al., "Parallel Flow Regenerator for Pulse Tube Cooler Applications", Advances in Cryogenic Engineering, 1998, pp. 1627–1633, vol. 43B Kluwer Academic/Plenum Publishers, New York, USA.

J. N. Chafe, et al., "Neodymium–Ribbon–Regenerator Cooling Performance in a Two–Stage Gifford–McMahon Refridgerator", Advances in Cryogenic Engineering, 1998, pp. 1589–1596, vol. 43B Kluwer Academic/Plenum Publishers, New York, USA.

J. R. Olson, et al., "Performance of a Two–Stage Pulse Tube Cryocooler for Space Applications", Cryocoolers 10, 1999, pp. 163–170, esp. pp. 167–168, Kluwer Academic/Plenum Publishers, New York, USA.

* cited by examiner

*Primary Examiner*—Henry Bennett
*Assistant Examiner*—Nihir Patel

(57) ABSTRACT

In a regenerator for a regenerative cycle machine, regenerator foil is grooved on both sides, with intersections of grooves on opposite side forming holes at which separate flows of fluid interact to induce flows ancillary to the overall direction of flow in the regenerator, thereby enhancing heat transfer to and from the material of the regenerator and improving thermodynamic performance of the gas cycle machine.

14 Claims, 8 Drawing Sheets

FOIL STRUCTURES FOR REGENERATORS

GOVERNMENT RIGHTS

The invention was made with Government support under contract F29601-99-C0171 awarded by the United States Air Force. The Government has certain rights in the invention.

BACKGROUND

1. Field of the Invention

This invention relates to foil for regenerators of regenerative gas cycle machinery.

2. Description of Prior Art

Regenerative gas cycle machines are a class of machinery that includes Stirling cycle engines and Stirling cycle, Gifford-McMahon, Vuilleumier, Solvay and pulse tube refrigerators. A regenerator is a critical component of all regenerative gas-cycle machines. The regenerator acts as a thermal sponge. Fluid passing back and forth through the regenerator leaves heat in the regenerator matrix in one direction of flow and picks up that heat as it passes back through the regenerator in the opposite direction.

Stacks of wire-mesh screens, wire felt materials, and beds of packed metal powder have been widely used as regenerators in gas cycle machinery because the materials are primarily used for other purposes, are produced in quantity, and are readily available in the marketplace. However, none of those materials is specifically designed to fulfill the special function of a regenerator. Regenerators fabricated from those materials all contain random fluid flow passages in the spaces between wires or grains of powder. The flow passages are of varying width, and a significant portion of the void volume in those regenerator is in spaces in which there is little or no fluid flow and thus little opportunity for heat transfer between the fluid and the regenerator matrix material. One advantage of those prior art materials was that the regenerator permitted lateral flows as well as flows in the overall direction of flow in the regenerator. That permitted imbalances in flow at different points in each cross section of the regenerator to be equalized by natural cross-flows. However, these materials contain no means for dynamically redistributing fluid laterally relative to the overall direction of flow in the regenerator.

Spaced layers of foil have also been used as the matrix material in regenerators in gas cycle machinery. Sheets of foil can be etched to create grooves on the surface of the foil. Foil can also be shaped by crimping or dimpling it, which avoids the loss of material in the etching process, but those techniques have not been sufficiently precise to produce acceptable regenerators. Moreover, solid layers of foil prevent cross-flows necessary to rebalance overall flow distribution over a cross section of the regenerator as fluid moves through it.

Etched foil regenerators used heretofore have partially solved the problem of flow passage width; if the foil is prepared carefully, flow passages are close to the same width throughout the regenerator. Perforations in etched foil have also permitted cross-flows, as in screen, felt and packed powder regenerators. In practice, performance of prior art foil regenerators has generally been disappointing.

Laboratory work with prior art foil regenerators shows that they offer lower pressure drop than felted material, stacked screens or packed powder, the standard regenerator materials. Computer models suggest that prior art foil regenerators should also provide good heat transfer, and, overall, superior performance.

Disappointing performance of prior art foil regenerators is due in part to inadequate heat transfer between the fluid and the foil. When fluid passes straight through the regenerator from one end to the other, the time that the fluid spends in transit is minimized, limiting the time during which heat transfer can take place. Moreover, boundary layers develop as fluid flows through the regenerator, impeding heat transfer.

Stainless steel can be used in foil regenerators operating down to about 30 Kelvins, but for regenerators to be used in coolers that reach temperatures below about 30 Kelvins, other, more expensive materials with better low-temperature heat capacity are required. Those materials include alloys of rare earth materials. Some of those materials can be formed into foil, but it is not economical to etch that foil to produce perforated regenerator foil because too much of the expensive material would be etched away and thus wasted.

Even with relatively inexpensive materials such as lead and its alloys, etching grooves on the material is not practical because the material is already relatively weak and etching grooves in the material weakens it further, exacerbating problems of handling and assembling it into a regenerator without damaging it.

SUMMARY OF INVENTION

In accordance with the present invention, a regenerator foil contains grooves on both surfaces, with the grooves intersecting each other to form openings through the foil and with the grooves oriented so as to produce secondary motions in the fluid in one or both sets of grooves. Those secondary motions enhance heat transfer between fluid and foil, thereby improving the performance of the regenerator. Those secondary motions also tend to continually redistribute fluid throughout the whole regenerator in a direction lateral to the overall direction of flow through the regenerator.

Multiple layers of stainless steel foil prepared according to this invention can be used as the heat sink medium for a regenerator with a cold end that operates at temperatures above about 35 Kelvin. Layers of stainless steel foil prepared according to this invention can also be interspersed between layers of other materials with greater heat capacity than stainless steel at temperatures below about 35 Kelvin. By employing foil of this invention as spacer material between layers of foil fabricated from alloys of rare earth (Lanthanide) elements, a regenerator effective to temperatures below 10 Kelvin may be fabricated.

OBJECTS AND ADVANTAGES

Several objects and advantages of this invention are:

(1) To provide high performance foil regenerators for use in gas cycle machines.

(2) To provide easily-fabricated elements from which foil regenerators may be assembled.

(3) To provide practical high-performance regenerators for coolers operating at temperatures below 30 Kelvins.

(4) To provide high performance foil regenerators for use in coaxial pulse tube refrigerators.

(5) To provide foil regenerators containing materials with high heat capacities at temperatures within a few Kelvins of absolute zero.

(6) To provide regenerators with high heat transfer rates induced by controlled secondary fluid flows.

Further objects and advantages will become apparent from a consideration of the ensuing description and drawings.

DRAWING FIGURES

REFERENCE NUMERALS IN DRAWINGS

Figure 1:
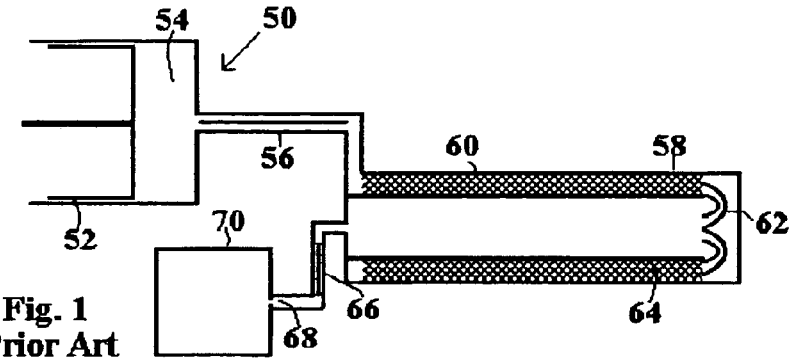
Fig. 1 Prior Art
FIG. 1 is a schematic view of a prior art coaxial pulse tube refrigerator.

22 slant-groove spacer foil
26 solid foil
50 compressor
52 piston
54 compression space
56 aftercooler
58 housing
60 regenerator
62 cold heat exchanger
64 pulse tube
66 warm heat exchanger
68 orifice
70 reservoir
80 multiple layers of foil
82 central opening
84 mandrel
86 unrolled sheet of foil
90 strip
92 slit
94 spacer-strap
96 groove, front side
98 groove, back side
99 unetched spacers
100 angled spacer-strap
110 hole
112 portion depth-etched from front
114 portion depth-etched from back
116 unetched foil
120 heat exchanger fin
122 heat exchanger slot
124 open groove
126 blocked groove
130 spacer foil
132 solid foil
134 lead foil
136 lanthanide series alloy
138 hot end of regenerator
140 cold end of regenerator Definitions: For purposes of this patent, "foil" means sheets of material that are thin relative to their other dimensions. "Surface " as applied to foil means one of the two surfaces of relatively large area, as distinguished from the edges, whose short dimension is approximately the thickness of the foil. "Grooved foil" means foil that has been sculpted, by photoetching or any other process, so that it has grooves on both sides, with the grooves on one side intersecting the grooves on the other side, forming holes in the foil at the places where grooves on opposite sides of the foil intersect. "Continuous" as applied to a groove means a groove at least as long as one complete wrap around a spiral-wrapped regenerator, or spanning from edge to edge of a piece of flat foil in a regenerator assembled from multiple separate pieces of foil. "Solid foil" means foil that has not been grooved or perforated. "Overall direction of flow" in a regenerator is the direction of a line drawn from the center of the end of a regenerator where fluid enters to the center of the end of the regenerator where fluid exits, in either direction of flow; individual parcels of fluid moving in the regenerator may follow other paths without altering the overall direction of flow.

DESCRIPTION

FIGS. 1–5—Prior Art

FIG. 1 is a schematic illustration of a prior-art coaxial pulse tube refrigerator. Compressor 50 has a piston 52 that cyclicically alters the volume of compression space 54, forcing fluid into and out of other components of the refrigerator including aftercooler 56, regenerator 60, cold heat exchanger 62, pulse tube 64, warm heat exchanger 66, and orifice 68 through which fluid passes into and out of reservoir 70. Although compressor 50 is shown with piston 52, alternate methods of generating cyclically varying pressure, such as a valved compressor, are equivalent.

Figure 2:
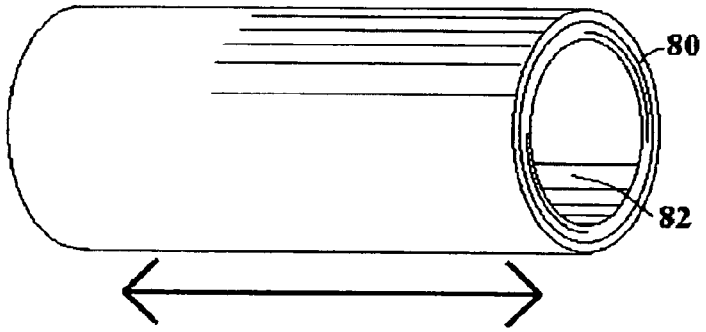
Fig. 2 Prior Art
FIG. 2 is a schematic perspective view of a prior art foil regenerator for a coaxial pulse tube cooler.

As fluid flows back and forth through regenerator 60, it leaves heat in the regenerator material as it flows in one direction and picks up heat from the regenerator material as it flows back in the other direction. The material of the regenerator must be porous to permit fluid to flow, and the size and shape of the flow passages determines both the effectiveness of heat transfer between regenerator material and fluid and the amount of pressure drop experienced by the flow. FIG. 2 shows detail of a regenerator comprised of multiple layers of foil 80, with a central opening 82, and suited for use in the coaxial pulse tube refrigerator of FIG. 1.

Figure 3:
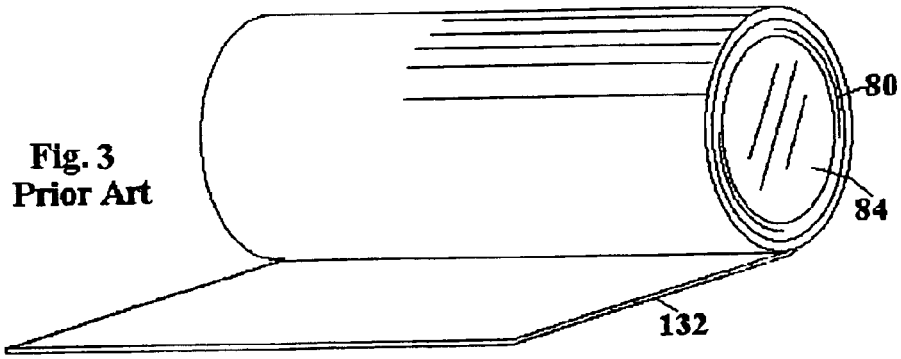
Fig. 3 Prior Art
FIG. 3 is a schematic perspective view of a prior art foil regenerator, spiral-wrapped on a mandrel.

FIG. 3 is a schematic cross section of a prior-art spiral-wrapped foil regenerator according to U.S. Pat. No. 5,429,177. Regenerator foil 61 is wrapped around a mandrel 84 which may be solid or may be a hollow tube that surrounds, or serves as, the pulse tube in the coaxial pulse tube refrigerator of FIG. 1 until the outer diameter of the wrapped assembly is almost as great as the inner diameter of housing 26. An outer layer may be solid foil 132.

Figure 4:
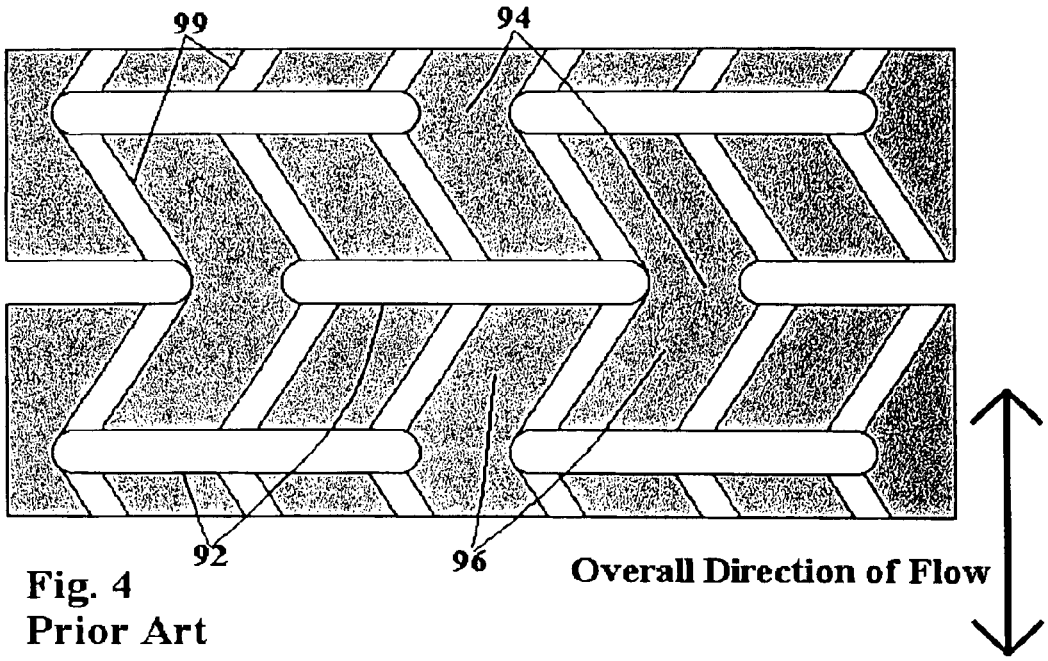
Fig. 4 Prior Art
FIG. 4 is a schematic view of a piece of prior art etched regenerator foil.

FIG. 4, prior art, illustrates a portion of a piece of regenerator foil of the general prior art type illustrated in FIG. 13 in U.S. Pat. No. 5,429,177. The foil is etched from both sides to create relatively short grooves normal to the overall direction of flow. The grooves are interrupted by spacer-straps 94 of foil that has not been etched completely through; spacer straps 94 hold the piece of foil together. Grooves 96 are entirely on the front side of the foil as drawn. Grooves 96 are arranged in a zigzag pattern relative to the overall direction of flow in the regenerator.

Figure 5:
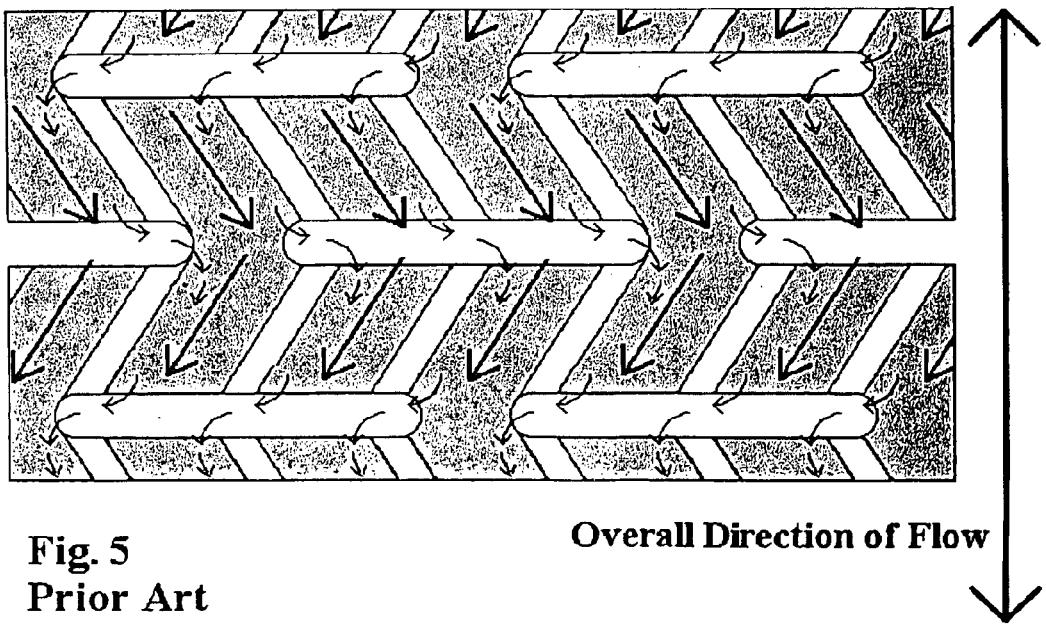
Fig. 5 Prior Art
FIG. 5 is a schematic representation of flow in the grooves of a piece of regenerator foil of FIG. 4.

FIG. 5, prior art, illustrates flow patterns in one direction of flow in the grooves on the surface of the foil of FIG. 4. The large arrows indicate the principal flow, which follows a zigzag path in the grooves, front side 96 of FIG. 4 between the zigzag spacers of FIG. 4. The small arrows in FIG. 5 show small induced flows in slits 92 of FIG. 4.

Figure 6A:
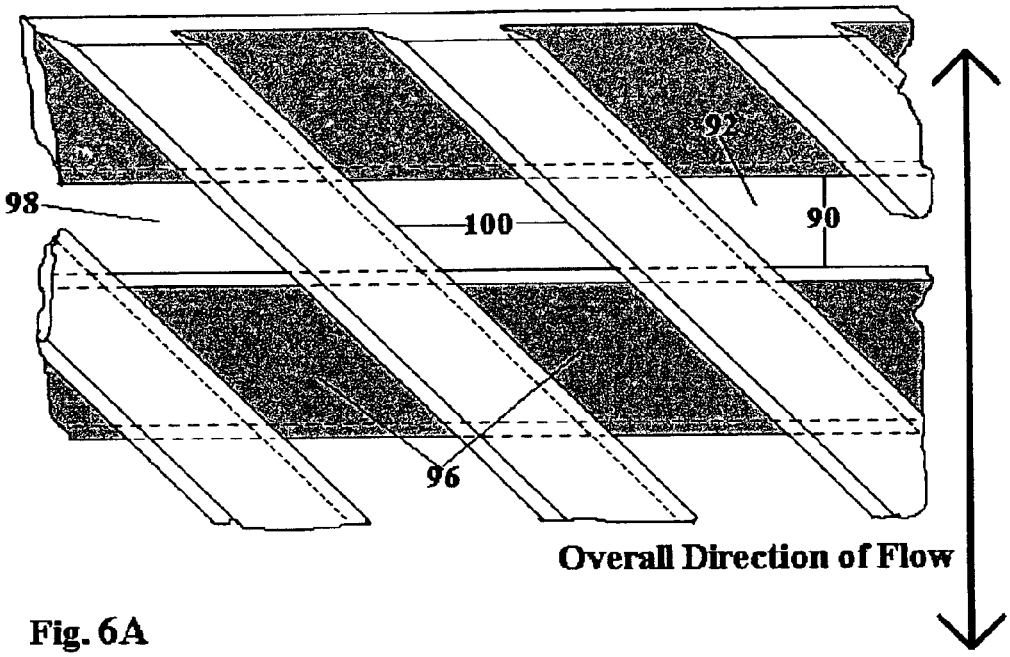
FIG. 6A is a schematic perspective view of a piece of regenerator foil of this invention with constant-slant grooves.

FIG. 6A shows the structure of a portion of a piece of regenerator foil of this invention. The overall direction of flow in the regenerator is between the top and bottom edges of the piece as shown. Strips 90 normal to the overall direction of flow comprise the back side of the piece of foil. Spacers 100 on the front side of the piece of foil are angled relative to the overall direction of flow, and relative to strips 90 on the back side. In practice, the etching process rounds the sharp edges shown schematically in FIG. 6A.

Figure 6B:
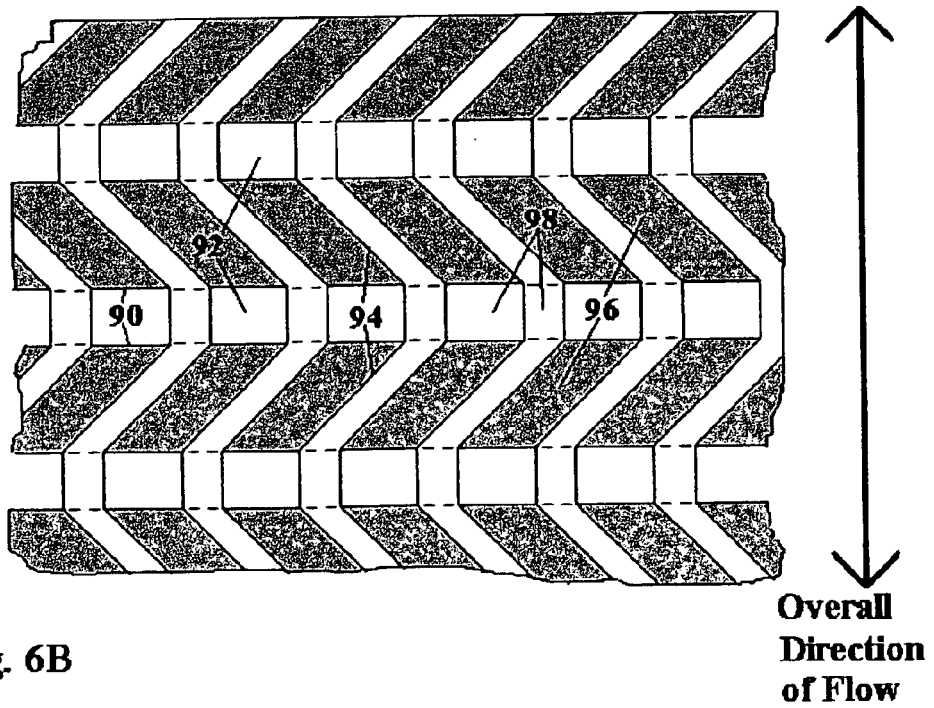
FIG. 6B is a schematic view of a piece of regenerator foil of this invention with zigzag-slant grooves.

FIG. 6B shows an alternate structure of a portion of a piece of regenerator foil of this invention. The overall direction of flow in the regenerator is between the top and bottom edges of the piece as shown. Strips 90 normal to the overall direction of flow comprise the back side of the piece of foil. Spacer straps 94 on the front side of the piece of foil are again angled relative to the overall direction of flow, and relative to the strips 90 on the back side of the piece of foil, but instead of stretching diagonally across the whole piece of foil, the slant of the spacer straps 94 periodically reverses. The reversal of direction occurs where spacer straps 94 cross the slits 92 between strips. Grooves 98 on the back side pass under spacer straps 94 which remain unetched on the front side.

Figure 7:
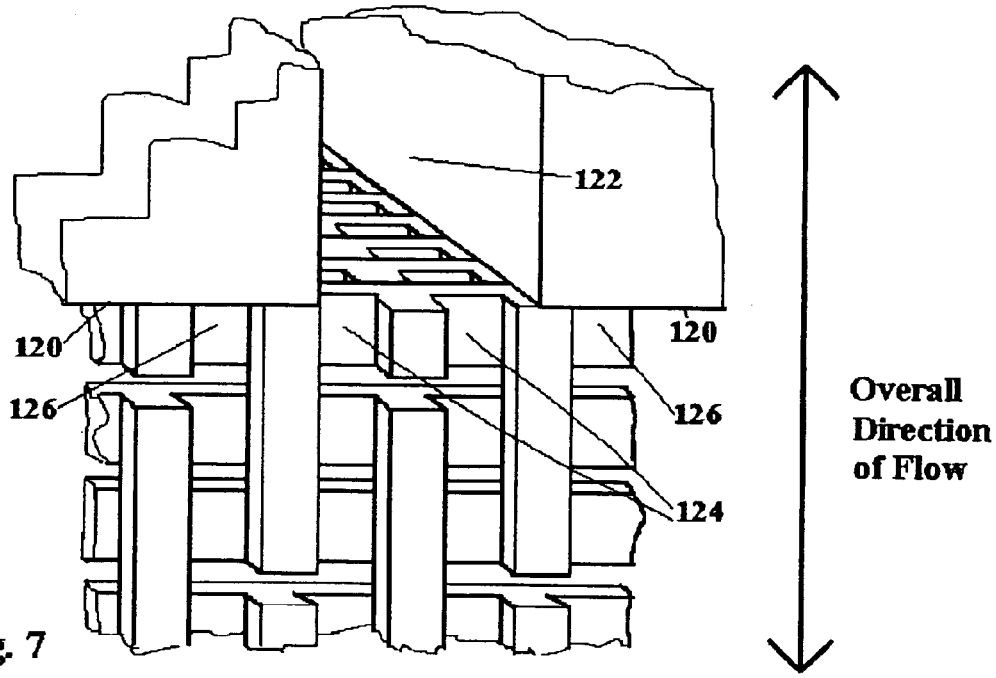
Fig. 7 Prior Art
FIG. 7 illustrates blockage of grooves in a piece of prior art etched regenerator foil.

FIG. 7 illustrates blockage of grooves in a piece of prior art regenerator foil where a prior art foil regenerator meets heat exchanger comprised of a block of metal fabricated to leave heat exchanger fins 120 on either side of heat exchanger slot 122. Grooves 124 are open to heat exchanger slot 122 but grooves 126 terminate against heat exchanger fins 120.

Figure 8A:
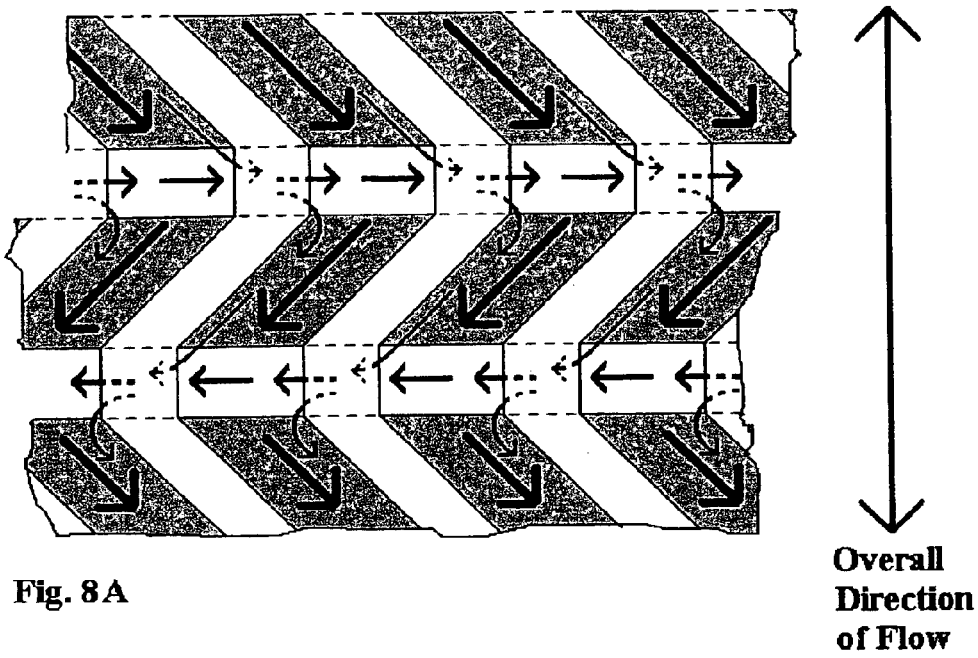
FIG. 8A illustrates flow in grooves in a piece of regenerator foil of this invention with zigzag spacers.

FIG. 8A illustrates flow patterns in one direction of flow in the grooves in the foil of FIG. 6B. The largest arrows indicate the principal flow, which follows a zigzag path in the grooves, front side 96 of FIG. 6B. The horizontal arrows show uninterrupted induced flows in grooves, back side 98 of FIG. 6B. The curved arrows indicated smaller flows periodically entering and leaving the continuous horizontal flow.

Figure 8B:
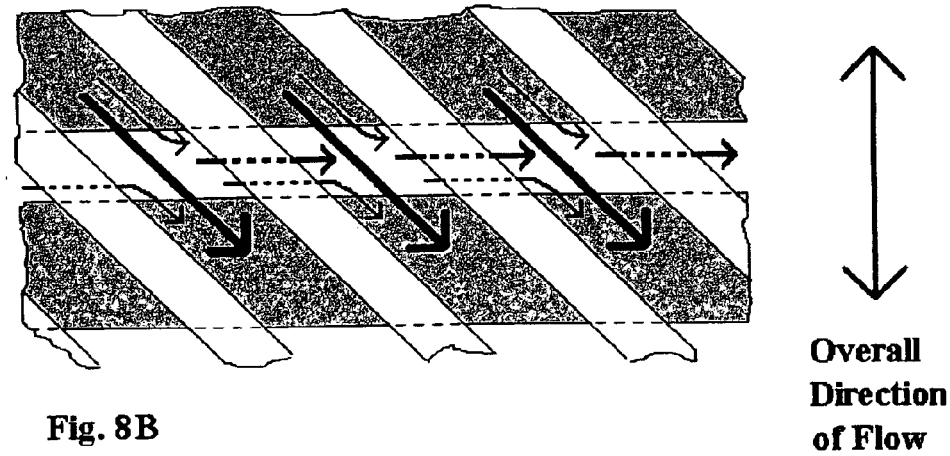
FIG. 8B illustrates flow in grooves in a piece of regenerator foil of this invention with constant-slant spacers.

FIG. 8B illustrates flow patterns in one direction of flow in the grooves in the foil of FIG. 6A. The largest arrows indicate the principal flow, which follows a diagonal path in the grooves, front side 96 of FIG. 6A. The horizontal arrows show uninterrupted induced flows in grooves, back side 98, of FIG. 6B. The curved arrows indicated smaller flows periodically entering and leaving the continuous horizontal flow on the back side.

Figure 9A:
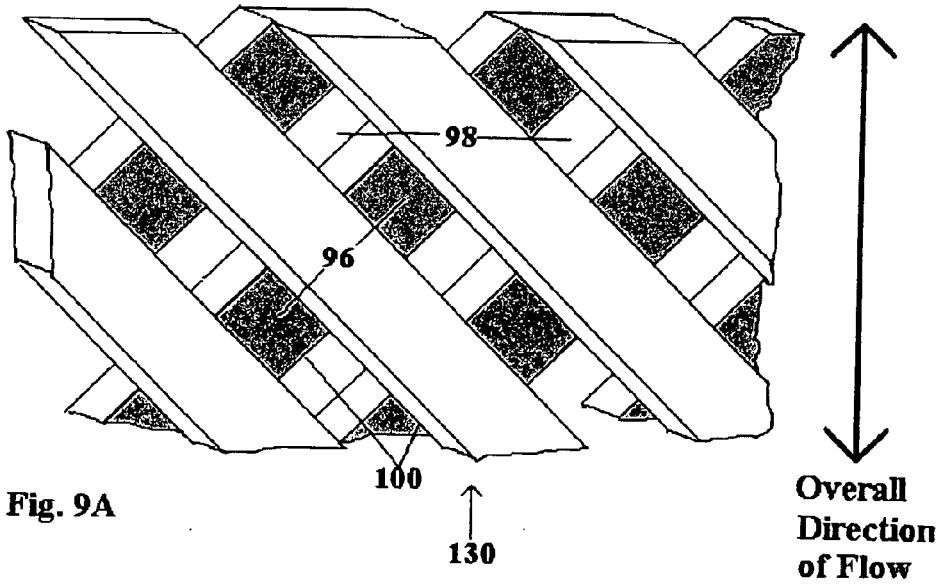
FIG. 9A is a schematic perspective view of a piece of spacer foil of this invention with constant-slant grooves.

FIG. 9A shows the structure of a portion of a piece of spacer foil of this invention. The overall direction of flow in the regenerator is between the top and bottom edges of the piece as shown. However, the grooves that form grooves, front side 96 and grooves, back side 98, are slanted relative to the overall direction of flow. That is, the grooves on the front side of the foil are angled down to the right and the grooves on the back side are angled down to the left. Where the grooves cross each other, there are holes in the foil. Where spacer straps 100 intersect each other, the full thickness of the original foil remains. The structure can be obtained by photoetching a piece of stainless steel foil in a manner known to the art. The structure is obtained by depth-etching grooves on both sides of the foil while leaving angled spacer spacer straps 100 between grooves.

Figure 9B:
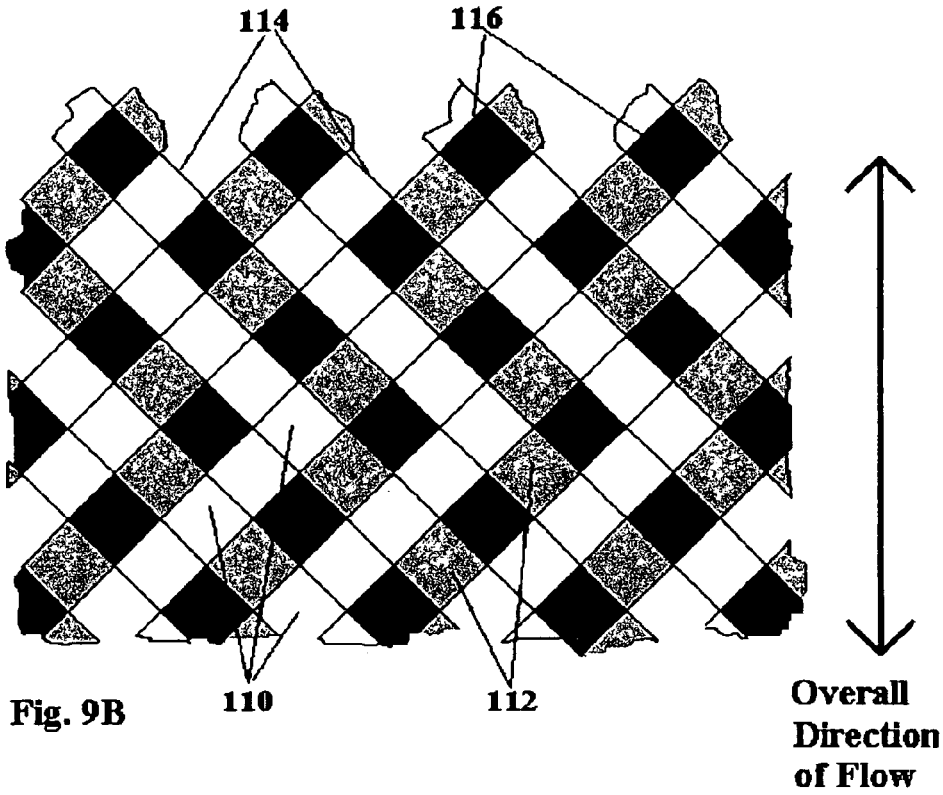
FIG. 9B is a schematic view of a piece of spacer foil of this invention with zigzag-slant grooves.

FIG. 9B shows the structure of a piece of spacer foil of this invention. The overall direction of flow in the regenerator is between the top and bottom edges of the piece as shown. The foil is etched in a pattern that creates zigzag grooves that cross and recross each other. The structure is obtained by etching a piece of solid foil in some places from one side, in some places from the other side, in some places from both sides (creating a hole) and in some places not at all. Holes 110, portions depth-etched from the front 112, portions depth-etched from the back 114 and portions of unetched foil 116 are arranged to create the flow pattern shown in FIG. 9C.

Figure 9C:
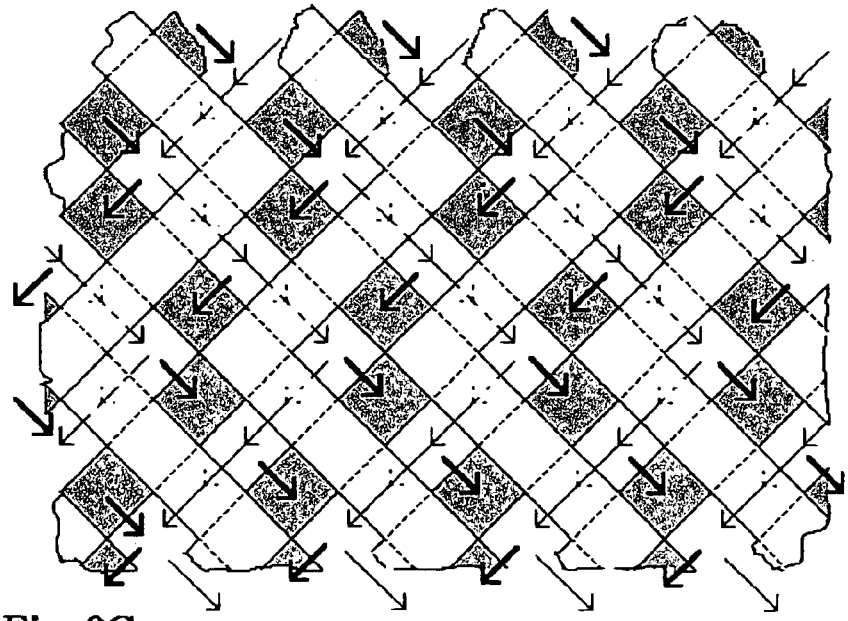
FIG. 9C illustrates the flow patterns in one direction of flow in the spacer foil of FIG. 9B.

FIG. 9C shows the main flow pattern in the grooves in the portion of the piece of foil shown in FIG. 9B. The dark arrows show the main flow on the front side of the foil. The lighter arrows show the pattern of flow in the grooves on the back side. Although flow direction on both sides reverses periodically, the flows on front and back sides cross each other repeatedly.

Figure 10A:
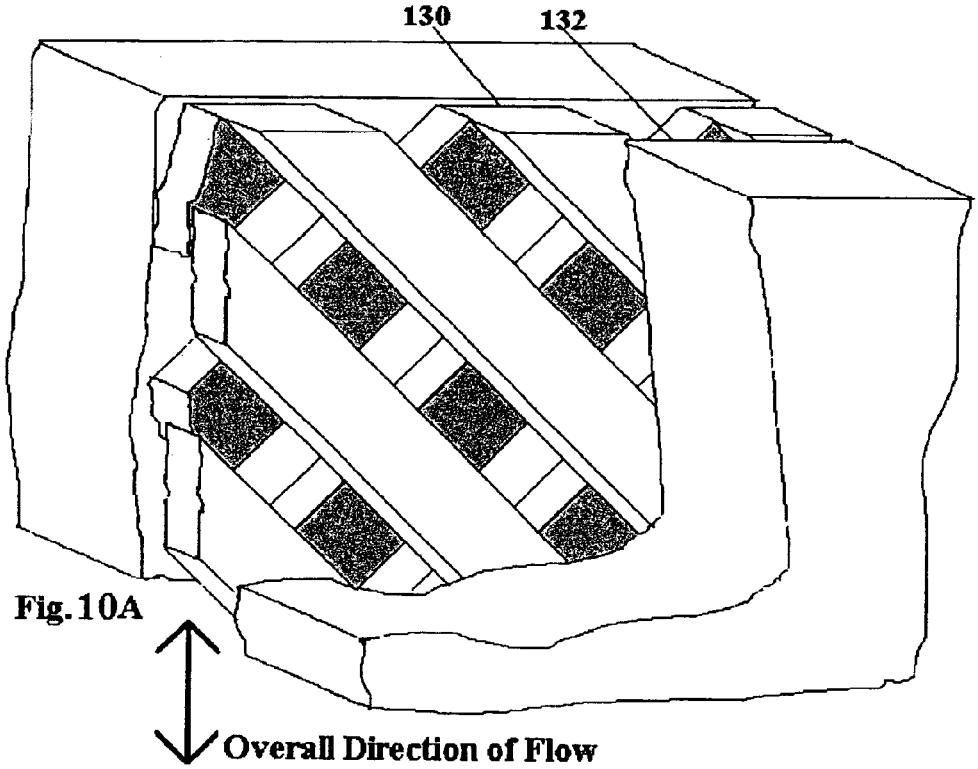
FIG. 10A is a perspective cutaway view of two layers of solid foil with a layer of spacer foil sandwiched between them.

FIG. 10A is a perspective cutaway view of two layers of solid foil with a layer of spacer foil sandwiched between them. A piece of slant-groove spacer foil 130 as shown in FIG. 9A is sandwiched between two pieces of solid foil 132.

Figure 10B:
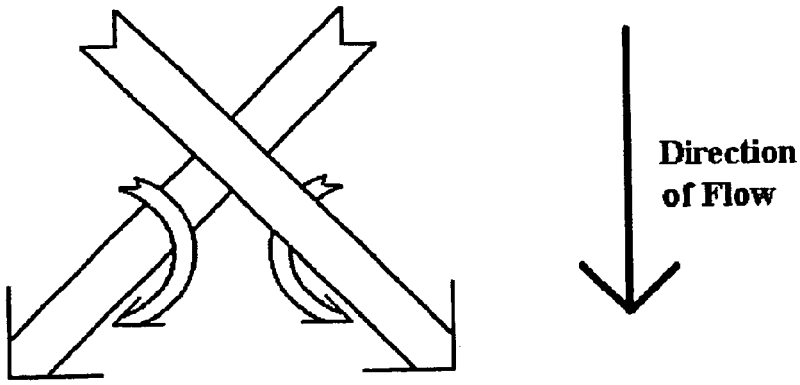
FIG. 10B illustrates flow in grooves of a piece of regenerator spacer foil of FIG. 10A.

FIG. 10B illustrates schematically the interaction of flow in intersecting grooves in slant-groove spacer foil 130 when the overall direction of flow in those passages is down and those passages are capped on both sides by solid foil as shown in FIG. 10A.

Figure 11:
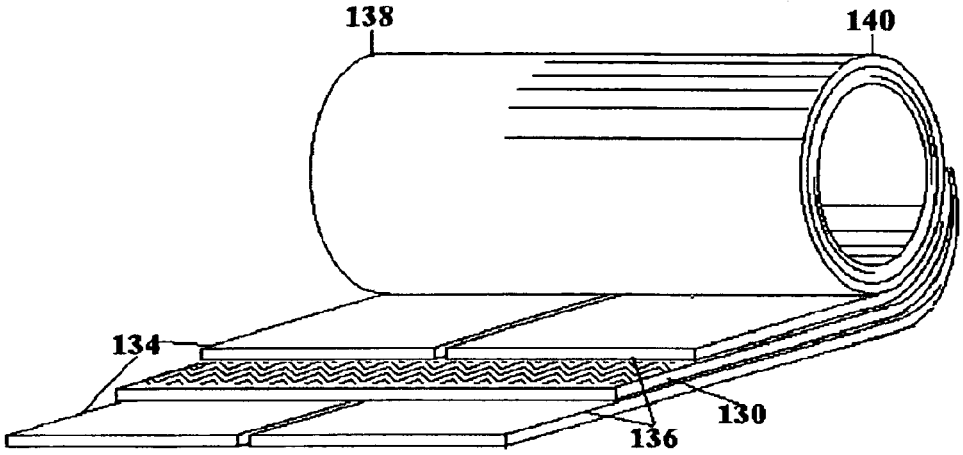
FIG. 11 is a perspective view of a partially unrolled foil regenerator with alternate layers of solid foil and regenerator spacer foil.

FIG. 11 shows in perspective a regenerator partially unrolled, with successive layers cut back to show a layer of spacer foil 130 between two layers of solid foil, with a strip of lead foil 138 rolled at the hot end of regenerator 138 and a strip of lanthanide series alloy (alloys containing any of the group of elements consisting of cerium, dysprosium, erbium, europium, gadolinium, holmium, lanthanum, lutetium, neodymium, praseodymium, promethium, samarium, terbium, thulium and ytterbium), rolled at the cold end 140 of the regenerator.

Description and Operation:

The basic principle of this invention is that grooves on opposite sides of a sheet of foil are oriented in such a way that when fluid flows in grooves on one side of the sheet, motion is imparted to fluid in grooves on the opposite side of the sheet. The motion imparted to fluid in grooves on the opposite side of the sheet is "induced flow". Induced flow enhances heat transfer, and thereby improves the performance of the regenerator.

In one embodiment of this invention, successive layers of foil embody the same structure. Flows in grooves on both sides of each layer interact with flows on the facing sides of adjacent layers. In that embodiment, the induced flow is in grooves normal to the overall direction of flow.

An alternate application of this invention is a regenerator comprised of alternate layers of solid foil with good thermal properties and layers of spacer material that need not have comparably good thermal properties. In that embodiment, induced flow is a rotating motion of the flow in grooves on both sides of the spacer material.

In preferred embodiments of regenerator foil and spacer foil, the foil structure is obtained by photoetching grooves on both sides of a sheet of stainless steel foil. Since the etching process goes deeper than 50% of the way through the foil, the foil is etched completely through its whole thickness at locations where grooves intersect. However, other methods of fabrication are equivalent if the end result is foil with grooves on both sides and holes where the grooves intersect.

Regenerator Foil

Imperfections in the interface between a regenerator and the heat exchangers at its ends tend to generate significant losses in performance of gas cycle machines. For example, a useful type of cold heat exchanger can be fabricated by cutting slots in a cylindrical copper block. Typically, that type of heat exchanger has wide fins between slots. Features on the regenerator are typically on a far smaller scale; the ends of the heat exchanger fins tend to contact a relatively large area at the end of a regenerator, blocking flow at the points of contact and channeling flow to a relatively small portion of the cross section of the end of the regenerator, as shown in FIG. 7. The resulting imbalance in flow distribution across the cross section of the regenerator causes thermodynamic losses. The regenerator foil of this invention reduces those losses.

In operation of this invention, flow entering at the edge of the foil through an unblocked groove will be driven through a slant groove 96 in FIGS. 6A and 6B until it reaches a groove oriented normal to the overall direction of flow through the regenerator. There, the flow will be forced to either change direction sharply to move into the next slant groove or to change direction less radically to move into a groove oriented normal to the overall direction of flow. The effect will be to drive the flow strongly through the circumferential groove 98 in FIGS. 6A and 6B, distributing it around the whole circumference of a layer of regenerator foil in a regenerator such as is shown in FIG. 1.

In foil shown in FIG. 6B, flow must reverse in order to move from a groove normal to the overall direction of flow into the next row of slant grooves. Again, at the end of the next slant grooves, fluid is forced into a circumferential groove from which it eventually emerges, with a change of direction, into yet another row of slant grooves. The flow-reversal process is repeated to ensure even distribution of flow between parallel axial grooves. The pattern shown in FIG. 6B may be repeated across the entire width of a foil in the overall direction of flow or a prior art pattern such as is shown in FIG. 4 or FIG. 7 may be used in the middle of the foil, away from the edges.

In addition to its basic function of redistributing flow, the slant groove pattern enhances regenerator performance in at least two ways. First, by lengthening the flow path of the slant groove relative to the path of an axial groove this invention lengthens the flow distance, increasing heat transfer effectiveness. Second, by driving a flow through the grooves normal to the overall direction of flow, forced convection between fluid and the walls of those grooves is improved, which again enhances heat transfer.

Spacer Foil

When a regenerator of this invention is constructed from alternate layers of spacer foil and solid foil the flow grooves on both sides of the spacer foil layers are capped by the adjacent layers of solid foil as shown in FIG. 10A. The solid foil layers provide the bulk of the heat capacity in the regenerator; the function of the spacer foil is primarily to facilitate heat transfer to and from the layers of solid foil. While the spacer foil contributes some heat capacity, the heat capacity of the regenerator as a whole is provided primarily by the solid foil.

The effect is that each front-side stream tends to push the edges of the intersecting back-side streams in the direction that the front-side stream is going, imparting a rotating motion to the back-side streams. The same is true the other way around; back-side flows tend to induce rotation in the front-side flows. That effect is illustrated in FIG. 10B.

The structure of the spacers is designed to cause fluid to flow diagonally across each side of the foil from edge to edge or, in a cylindrical regenerator, to trace helical paths from one end of the regenerator to the other. The direction of rotation of helical flows on one side of each layer of spacer foil is the opposite of the direction of rotation of on the other side. The angle of the spacers determines the pitch of the helixes, and thus the distance that fluid must flow to move from one end of the regenerator to the other. A smaller angle produces a shorter flow path and less violent interaction where streams on opposite side of the spacer foil cross each other. A larger angle creates more violent interaction. A larger angle also creates a longer flow path and thus a larger opportunity for heat transfer. Both the extent of interaction between the intersecting streams and the length of the flow paths for those streams affect both heat transfer and pressure drop. Optimization of the angle between flow grooves on the front and back sides of the spacer material depends on the particulars of the application, particularly the type of cryocooler and frequency at which it operates. Optimization can be accomplished by techniques known to the art.

Etched stainless steel foil is an appropriate spacer material, but other materials could also be formed into an appropriate grid shape to accomplish the intended purpose of guiding flows between the layers of solid foil. Preferred dimensions of materials for a cryocooler regenerator are 75 microns (0.003") thick for the solid foil and 50 microns (0.002") for maximum thickness of spacer foil (i.e. at the intersections of spacer bars).

The width of the spacers and the flow grooves between them, relative both to each other and to the thickness of the spacer layer, should be such that the main direction of flow in each flow groove is maintained. If the grooves are wide relative to the thickness of the spacer layer, flow will tend to move straight through the regenerator, weaving back and forth from grooves on one side of the spacer layer to grooves on the other side. If, however, the grooves are narrow, flow will tend to follow those grooves, interacting with flow in grooves on the other side of the spacer mainly by rotating. As a first approximation, grooves in the spacer layer should be the minimum width that is possible to be achieved by a photoetching process.

Similarly, the spacers between grooves should be optimized to achieve the desired vortex flow in the grooves while maximizing the heat transfer surface in contact with the fluid. If the spacers are relatively wide, the intersections will be widely spaced, which is desirable in maintaining separate flow in each channel but tends to blank out much of the heat transfer surface of the solid foil. The frequency of the cycle of the gas cycle machine will determine the effective penetration depth of heat moving in and out of the solid foil. At low speeds, in the order of a few Hertz, it may be possible to achieve adequate heat penetration even into the material of the solid foil that is in contact with the spacers. Again, optimization of the spacer bar width can be accomplished by techniques known to the art.

If different solid foil material is desired at different locations through the regenerator, it may be assembled with narrow strips of several different solid foil materials. The solid foil may thus have thermal properties optimized for the temperature gradient from one end of the regenerator to the other. A single piece of spacer material may be inserted between mixed layers of solid foil comprised of different materials as shown in FIG. 11.

Conclusion, Ramifications, and Scope

This invention improves upon prior art foil regenerators by employing patterns that force rather than merely permit secondary flows. As a consequence, although the overall direction of flow in a regenerator of this invention is not altered, the flow paths that individual parcels of fluid follow in passing through the regenerator continually redistribute flows circumferentially in an annular regenerator in which each layer is regenerator foil bearing the same pattern of grooves.

The principle of dynamic generation of secondary flows is also employed in a composite regenerator in which layers of spacer foil with indifferent heat capacity are interleaved with layers of solid foil made from materials with superior heat capacity at the temperatures that those layers experience in operation. Interaction of intersecting streams in grooves on the spacer foil generates a rotating motion in each stream, enhancing heat transfer between the fluid and the solid foil with which it comes in contact.

Although the description above contains many specifics, these should not be construed as limiting the scope of the invention but merely as providing illustrations of some of the presently preferred embodiments of this invention Thus, the scope of the invention should be determined by the appended claims and their legal equivalents, rather than by the examples given.

I claim:

1. In a regenerator comprising multiple layers of foil, an improvement comprising:

a layer of foil containing a multiplicity of continuous grooves on a first surface thereof and a multiplicity of grooves on a second surface thereof wherein said grooves on said first surface are slanted relative to the overall direction of flow in said regenerator, and wherein said grooves on said second surface are slanted relative to the overall direction of flow in said regenerator, and wherein said grooves on said first surface intersect said grooves on said second surface, and wherein the intersections of said grooves on said first surface and said grooves on said second surface comprise holes in said layer of foil.

2. The improvement of claim 1 wherein said layer of foil is comprised of stainless steel.

3. The improvement of claim 1 wherein said grooves on said first surface are formed by etching.

4. The improvement of claim 3 wherein said grooves on said second surface are formed by etching.

5. The improvement of claim 1 wherein the depth of said grooves on said first surface is between 50% and 60% of the greatest thickness of said layer of foil.

6. The improvement of claim 5 wherein the depth of said grooves on said second surface is between 50% and 60% of the greatest thickness of said layer of foil.

7. In a foil regenerator, an improvement comprising:

multiple alternate layers of solid foil and spacer foil, wherein a layer of said spacer foil contains a multiplicity of grooves on a first surface thereof and a multiplicity of grooves on a second surface thereof, and wherein said grooves on said first surface intersect said grooves on said second surface, and wherein intersections of said grooves on said first surface with said grooves on said second surface comprise holes in said layer of spacer foil, and wherein grooves on said first surface are angled relative to the overall direction of flow in said foil regenerator.

8. The improvement of claim 7 wherein said grooves on said second surface of said layer are angled relative to the overall direction of flow in said foil regenerator.

9. The improvement of claim 7 wherein the material of said layers of solid foil comprises the element lead.

10. The improvement of claim 7 wherein the material of said layers of solid foil comprises an alloy containing an element selected from the group of elements consisting of cerium, dysprosium, erbium, europium, gadolinium, holmium, lanthanum, lutetium, neodymium, praseodymium, promethium, samarium, terbium, thulium and ytterbium.

11. The improvement of claim 7 wherein a portion of the material of said layers of solid foil comprises the element lead and an adjacent portion of the material of said layers of solid foil comprises an alloy containing an element selected from the group of elements consisting of cerium, dysprosium, erbium, europium, gadolinium, holmium, lanthanum, lutetium, neodymium, praseodymium, promethium, samarium, terbium, thulium and ytterbium.

12. The improvement of claim 7 wherein said grooves on a surface of said layer of said spacer foil are formed by etching.

13. The improvement of claim 7 wherein the depth of said grooves on said first surface is between 50% and 60% of the greatest thickness of said layer of said spacer foil.

14. The improvement of claim 13 wherein the depth of said grooves on said second surface is between 50% and 60% of the greatest thickness of said layer of said spacer foil.

* * * * *